United States Patent [19]

Kelly

[11] 4,432,452

[45] Feb. 21, 1984

[54] PROTECTIVE RAZOR PACKAGE

[75] Inventor: John F. Kelly, Randolph, Mass.

[73] Assignee: The Gillette Company, Boston, Mass.

[21] Appl. No.: 379,592

[22] Filed: May 19, 1982

[30] Foreign Application Priority Data

Jun. 19, 1981 [GB] United Kingdom ..... 8118888

[51] Int. Cl.[3] ..... B65D 75/58; A45D 27/29; B65D 75/64

[52] U.S. Cl. ..... 206/354; 206/349; 206/485; 206/372

[58] Field of Search ..... 206/354, 349, 589, 588, 206/372, 485

[56] References Cited

U.S. PATENT DOCUMENTS

| | | | |
|---|---|---|---|
| 942,483 | 12/1909 | Clark | 206/228 |
| 2,593,689 | 4/1953 | Mitchell | 206/422 |
| 2,825,496 | 3/1958 | Miessler, Sr. | 229/37 R |
| 3,241,660 | 3/1966 | Cathcart, Jr. et al. | 206/45.14 |
| 3,847,282 | 11/1974 | Collura et al. | 206/491 |
| 3,978,980 | 9/1976 | Roccaforte | 206/45.14 |
| 4,131,198 | 12/1978 | Fischer | 206/419 |
| 4,140,244 | 2/1979 | Clabby | 221/281 |
| 4,153,162 | 5/1979 | Samsing | 206/372 |
| 4,231,510 | 11/1980 | Beard | 229/39 B |
| 4,266,664 | 5/1981 | Dixon et al. | 206/349 |
| 4,341,306 | 7/1982 | Lightsey | 206/372 |

FOREIGN PATENT DOCUMENTS

| | | |
|---|---|---|
| 619154 | 3/1949 | United Kingdom . |
| 951777 | 3/1964 | United Kingdom . |
| 960546 | 6/1964 | United Kingdom . |
| 1340750 | 12/1973 | United Kingdom . |

*Primary Examiner*—William T. Dixson, Jr.
*Assistant Examiner*—Brenda J. Ehrhardt
*Attorney, Agent, or Firm*—Raymond J. De Vellis

[57] ABSTRACT

A package for a plurality of safety razors each having an elongated handle and a transversely extending shaving head on the upper end thereof. The package is formed from a card which is cut, shaped and secured to form an open-ended envelope having opposed side walls and opposed end walls. Two groups of razors, which are reversed end for end, are mainly housed within the envelope. Each end wall has an aperture through which the lower ends of the handles of one group project. Each side wall has an aperture through which portions of the razor heads project. In a preferred embodiment, the projecting head portions are protected by flaps which are formed integral and coplanar with their respective end walls.

3 Claims, 4 Drawing Figures

PROTECTIVE RAZOR PACKAGE

BACKGROUND OF THE INVENTION

This invention relates to the packaging for safety razors.

More particularly, this invention relates to protective razor packaging for disposable razors.

U.S. Pat. No. 4,266,664 discloses a package for a plurality of razors made from card which is cut, folded, and secured to form an envelope enclosing a major part of the lengths of the razor handles, the razor heads projecting to either side of the envelope through elongated slots. The projecting heads of the razors are protected by a pair of laterally projecting integral flaps.

The present invention is also concerned with a relatively simple package for safety razors, but one which is better suited to the compact packaging of a larger number of razors than is the packaging disclosed in U.S. Pat. No. 4,266,664.

SUMMARY OF THE INVENTION

In accordance with the invention, a package is provided for a plurality of razors, each having an elongated handle and a transversely extending shaving head at the upper end thereof. The package is formed from card which is cut, shaped, and secured to form an envelope having an opposed pair of side walls and an opposed pair of end walls. A first group of razors is accommodated in the envelope with the lower end portions of their handles projecting through one end wall and with portions of their heads projecting through one side wall. A second group of razors is positioned to be reversed end for end with those of the first group, and having the lower end portions of their handles projecting through the other of the end walls, and portions of their heads projecting through the other of the side walls.

In a preferred embodiment, the projected head portions are protected by flaps which are formed integral and co-planar with their respective end walls.

BRIEF DESCRIPTION OF THE DRAWINGS

This invention both as to its organization and principles of operation, together with further objects and advantages thereof may be better understood by referring to the following detailed description of an embodiment of the invention in conjunction with the accompanying drawings in which.

DESCRIPTION OF A PREFERRED EMBODIMENT

Figure 1:
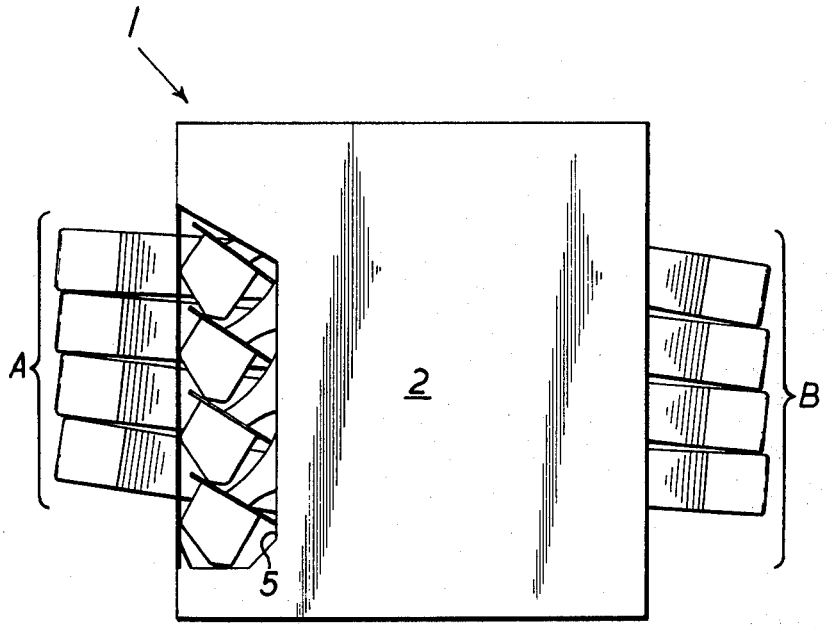
FIG. 1 is a side view of the package, in accordance with this invention.
Figure 2:
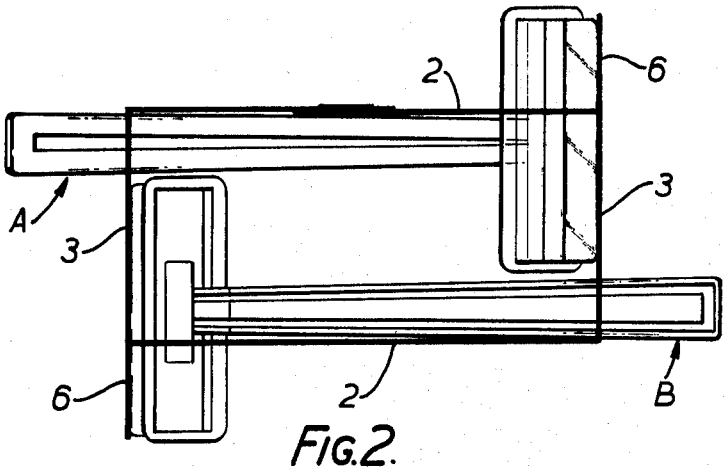
FIG. 2 is a top view of the package of FIG. 1, in accordance with this invention.
Figure 3:
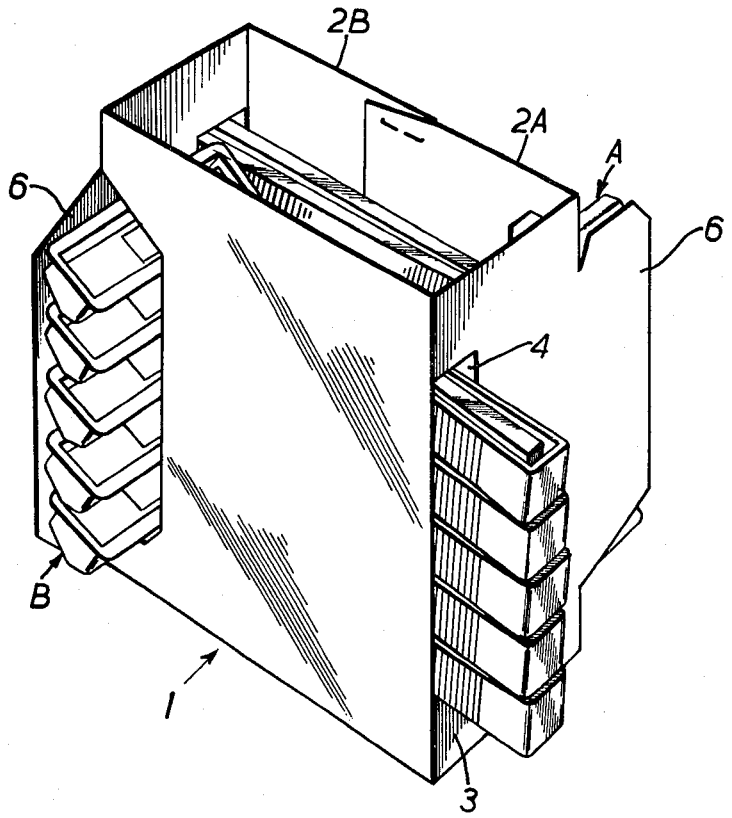
FIG. 3 is a perspective view of a slightly modified package, in accordance with this invention.

The package shown in FIGS. 1 to 3 is formed from a single piece of card which is cut, folded and secured to form an envelope 1 open at the top and bottom, and having an opposed pair of side walls 2 and an opposed pair of end walls 3.

The envelope is of rectangular cross-section, and the end walls 3 are formed, adjacent diagonally opposite corners with respective elongated slots 4, best shown in FIG. 3. Correspondingly, the side walls 2 are formed at diagonally opposite corners with respective to elongated slots 5, complementary in profile to respective flaps 6 which are each integral and coplanar with the adjacent end wall 3.

A first group of razors 'A' is disposed adjacent one side wall 2 with their handles projecting out of the adjacent end wall slot 4 and portions of their heads projecting through the slots 5 in the said one side wall. These projecting head portions are protected from above by the adjacent integral flap 6.

A second group of razors 'B' is reversed end for end with respect to the first group and their handles and outer head portions co-operate in similar manner to the respective slots 4 and 5 and flaps 6.

Figure 4:
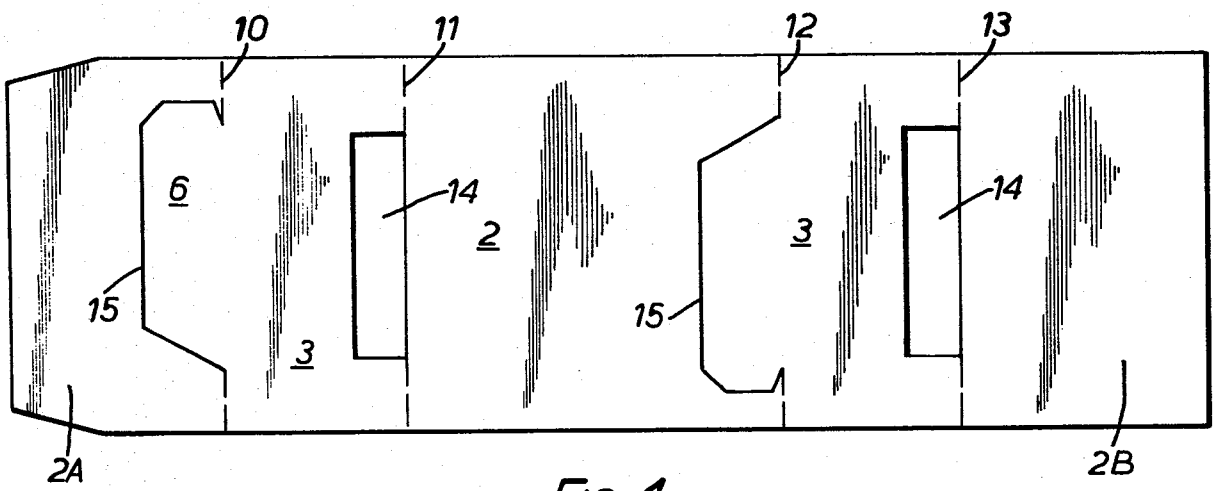
FIG. 4 is a view of the blank from which the packages of FIGS. 1 to 3 are formed, in accordance with this invention.

A suitable blank for making up the package is shown in FIG. 4. It has four parallel fold lines 10, 11, 12, 13 preformed, two blanks 14 stamped out to form the slots 4, and profiled cut lines 15 to define the flaps 6.

In the folded package or carton, the panels 2A, 2B are brought together with an overlap at which they are stapled, glued or otherwise secured together to form one side wall 2 and thereby complete the envelope.

The packaging shown in FIG. 1 is for eight razors arranged in two groups of four. The packaging shown in FIG. 3 is for ten razors in groups of five. However, it is within the scope of this invention to provide a packaging for razors greater than ten in number. Further, the number of razors in each group need not be equal in number. The invention, therefore, is not to be restricted except as is necessary by the prior art and by the spirit of the appended claims.

What is claimed as new and desired to be secured by Letters Patent of the United States is:

1. A package for a plurality of razors each having an elongated handle and a transversely extending shaving head at the upper end thereof, the package being formed from card which is cut, shaped and secured to form an envolope having an opposed pair of side walls forming a first side wall and a second side wall and an opposed pair of end walls forming a first end wall and a second end wall, a first group of razors being accommodated in the envelope with the lower end portions of their handles projecting through only said first end wall and with portions of their heads projecting through only said first side wall, and a second group of razors in a side-by-side orientation with said first group of razors and being reversed end for end with those of the first group, and having the lower end portions of their handles projecting through only said second end wall, and portions of their heads projecting through only said second side wall.

2. A package according to claim 1, wherein the razor handles of each group of razors lie closely adjacent a respective side wall of the package.

3. A package according to claim 2 wherein a flap is formed, integral with each end wall of the package, and extending laterally beyond the adjacent side wall and adjacent the projecting head portions of the respective group of razors so as to overlie the said projecting head portions.

* * * * *